United States Patent [19]

Rahmstorf

[11] 4,185,412

[45] Jan. 29, 1980

[54] TOY FIGURE WITH ACCESSORIES

[75] Inventor: Dietmar Rahmstorf, Nuremberg, Fed. Rep. of Germany

[73] Assignee: BIG Spielwarenfabrik Dipl.-Ing. Ernst A. Bettag, Fürth, Fed. Rep. of Germany

[21] Appl. No.: 866,222

[22] Filed: Jan. 3, 1978

[30] Foreign Application Priority Data

Jan. 18, 1977 [DE] Fed. Rep. of Germany ..... 2701754

[51] Int. Cl.[2] ..... A63H 13/00

[52] U.S. Cl. ..... 46/116; 46/157

[58] Field of Search ..... 46/22, 151, 116, 115, 46/157

[56] References Cited

U.S. PATENT DOCUMENTS

| | | | |
|---|---|---|---|
| 2,506,328 | 5/1950 | Alger | 46/22 |
| 3,051,959 | 9/1962 | Baws | 46/116 X |
| 3,419,993 | 1/1969 | Rodgers | 46/22 |
| 3,520,078 | 7/1970 | Klamer | 46/22 |
| 3,783,554 | 1/1974 | Shapero | 46/157 X |

FOREIGN PATENT DOCUMENTS

| | | | |
|---|---|---|---|
| 1112903 | 3/1956 | France | 46/22 |

OTHER PUBLICATIONS

"Snap-n-Play" Building Blocks, Barry Toycraft, 1965 Catalog, Mar. 10, 1965.

*Primary Examiner*—Russell R. Kinsey
*Assistant Examiner*—Mickey Yu

[57] ABSTRACT

A toy figure has a head, a trunk, legs and arms wherein accessories such as representations of clothes made from an essentially non-deformable material can be mounted at the region of the trunk. To enable accessories to be mounted easily and reliably, to afford wide freedom in the shaping of the accessories and closely to approximate them to the natural appearance, the front and/or rear of the trunk has at least one detent member at which an accessory can be removable secured by a counterpiece fixed to the accessory. The accessory extends only over the front or rear of the toy figure and laterally around the trunk to about the vertical plane passing through connections of the arms.

6 Claims, 3 Drawing Figures

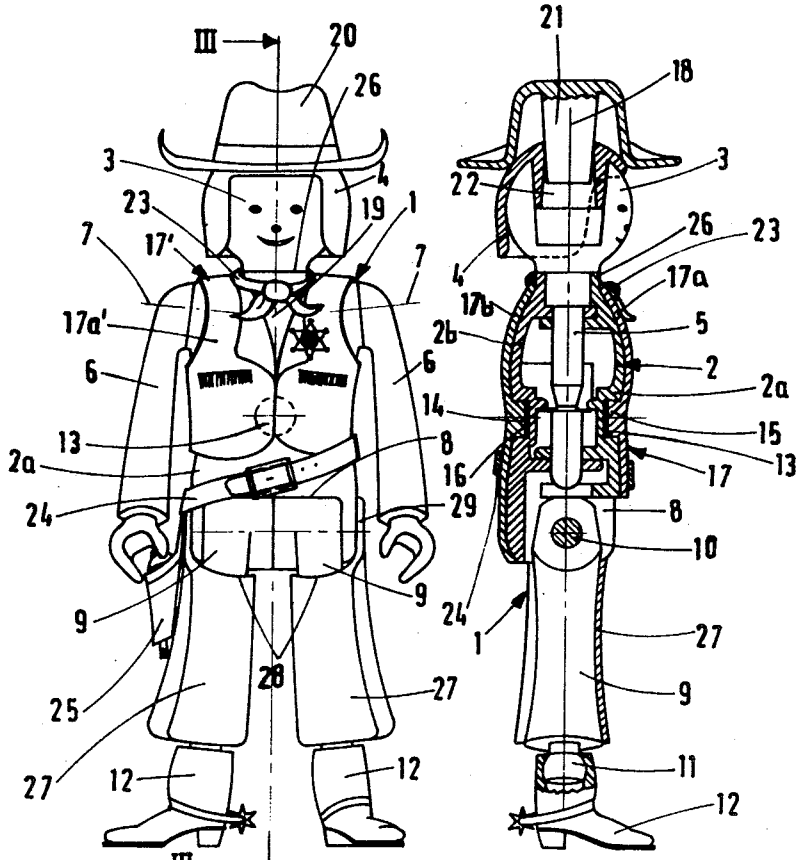
Fig. 3
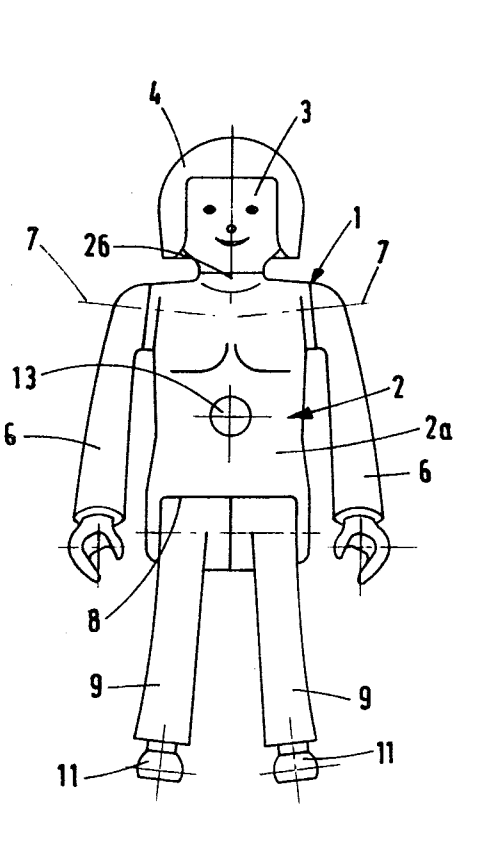
Fig. 2
Fig. 1

TOY FIGURE WITH ACCESSORIES

BACKGROUND OF THE INVENTION

1. Field of the Invention:

The invention concerns a toy figure with a head, a trunk, a pair of arms and a pair of legs, wherein accessories, e.g. representations of garment pieces, made fron non-deformable or scarcely deformable working material can be mounted on at least the trunk region of the figure.

2. Description of the Prior Art:

Toy figures of this kind and made from plastics are known. To enable their appearance to be altered, plastics accessories, e.g. capes and warning (safety) vests are used. Until know these clothing pieces have been secured either by providing them with a suitable neck opening with which they could be snapped around the neck of the figure, or by forming them with an upper cut-out portion, e.g. for warning (safety) vests, which then had to be pushed over the head of the figure. It is disadvantageous in both cases that only quite specific accessories could be fastened in this way. Normal garments, e.g. jackets or the like, could not be put on in this way. The use of an upper opening is additionally disadvantageous because the opening must have a diameter sufficient to enable it to be pushed over the head. As a consequence, however, the edge of this opening is then spaced too far from the neck, thus not corresponding to the natural model (reality) which is sought to be achieved. Also, a further drawback of pushing over the head is that before putting the accessory on, a hat, wig or other head-gear or decoration must generally be taken off first.

SUMMARY OF THE PRESENT INVENTION

The underlying task of the invention is to to construct a toy figure of the above-described type that, on the one hand, accessories may easily and reliably be put on and, on the other hand, that there should be wide freedom in the shaping of the accesory, and in particular a better approximation to the natural model should be possible.

The task is sought to be achieved in a toy figure of the above-described type in that at its front and/or rear side the trunk has respectively at least one detent or snap member at which an accessory is detachably securable by way of a complementary or counter-member that is rigidly fixed to the accessory, the accessory extending only over the front or rear side of the toy figure and laterally around the trunk up to about the vertical plane passing through the (pivot) connection of the respective arm.

Such a construction of the toy figure makes it possible to put on accessory parts of almost any desired shape so long as the condition is observed that the accessories extend approximately only to the vertical central plane between the front and rear sides of the trunk. The accessory may easily yet reliably be put on and taken off by using the detent member, with no specially large gap from the neck or the like requiring to be left. A toy figure according to the proposal of this invention may, for instance, be shaped initially with a "naked" torso or upper trunk portion. Then accessories in the form of garment pieces of almost arbitrarily selected shape may be put on this trunk. Furthermore, the possibility arises of using accessories with manifestly female shapes, so that it becomes possible to represent or build male as well as female figures starting from a neutral basic figure.

For example, garment pieces generally extend all the way around the trunk. To enable accessories of such a kind to be put on toy figures accordng to the invention, it is proposed to divide the accessory that is to surround the trunk completely into a front accessory part and a rear accessory part along the vertical plane that passes through the pivot connections of the arms, and then both the front and rear accessory parts may be separately secured at the trunk by means of respective detent members and counter-members so that the lateral edges thereof are aligned with (fitted to) each other.

Advantageously, the internal surface of the accessory or accessories fixed to the trunk by way of the detent member(s) and counter-member(s) is matched to that region of the trunk surface which it covers or they cover in the use position, because then the accessory fits particularly well; such a construction does not give rise to any difficulties in the manufacture of accessories made from plastics.

Expediently, a recess or notch in the trunk serves as the detent member into which an internal projection of the respective accessory may be pressed, as counter-member, in the fitting position; in a simple construction the recess or notch in the trunk and the projection of the accessory are formed with a circular shape in plan view. In this way one obtains a kind of press stud (snap) fastening.

The strength of the detent fastening may be enhanced by increasing the cross-section of the recess or notch in the trunk in the direction away from the surface of the trunk, i.e. uniformly conically, and forming the associated projection of the accessory in a correspondingly widening shape.

Finally, it is within the scope of the invention to form at least the accessories of one piece with their associated counter-member from a somewhat resiliently deformable plastics material.

BRIEF DESCRIPTION OF THE DRAWING

Further characteristics, details and advantages of the invention will appear from the following description of a preferred embodiment illustrated in the drawing. The drawing shows:

FIG. 1 is a front elevation of a toy figure without accessories;

FIG. 2 is a view of the toy figure corresponding to FIG. 1, but after attaching accessories to it; and FIG. 3 is a vertical section along the plane III—III in FIG. 2, through a toy figure provided with accessories which, however, partially differ from the acessories shown in FIG. 2.

DESCRIPTION OF THE PREFERRED EMBODIMENT

As shown in the drawing, the toy figure 1 consists of a trunk 2 made up of two parts and at which a head 3 with a hairpiece 4 is secured by a vertical pin 5 which at the same serves to interconnect the two trunk parts. Additionally, two arms 6 are secured to the trunk 2 for pivotal movement about generally horizontal axes 7. At the bottom the trunk 2 is provided with a journal opening 8 in which legs 9 are journalled by way of bearing pins 10 for pivoting between the vertical position illustrated in the drawing and a horizontal sitting position. Thus for the toy figure of this prefered embodiment basically corresponds to the toy figure described in DT-OS No. 25 06 786 (=U.S. Pat. No. 3 995 395 =GB-PS No. 1 497 013 and others). Further correspondance between these toy figures lies also in that at the lower ends of the legs 9 ball extensions 11 are provided on which shoes 12 may be snapped.

The particularity of the toy figure according to the present invention consists in that the trunk 2 is provided both at its front portion 2*a* and at its rear portion 2*b* with a respective detent or snap member 13 (at the front portion 2*a*) and 14 (at the rear portion 2*b*). As shown in FIGS. 1 and 3, the detent member 13 are round recesses starting from the trunk surface. They widen conically towards their interior, as may be seen from FIG. 3. The detent members 13, 14 co-operate with complementary detent counter-members 15, 16 (FIG. 3) which are constructed correspondingly as round members conically widening towards their free end surfaces to match the recesses constituted by the detent members 13, 14. In the illustrated embodiment the detent counter-members 15, 16 are made of one piece respectively with a front accessory portion 17*a* and a rear accessory portion 17*b* (FIG. 3), the complete accessory designated by 17 as a whole being divided into these accessory portions by a vertical plane passing through the vertical central axis 18. In the embodiment illustrated in FIG. 3 the accessory 17 represents a jacket that practically wholly surrounds the front and rear of the trunk 2. In contrast, FIG. 2 shows an accessory 17' which is correspondingly divided into a front portion 17*a'* and a non-illustrated rear accessory portion but which has the form of a short waistcoat or bolero which is, furthermore, provided with an opening 19.

From FIG. 3 it may also be seen that the internal surface of the accessory 17 is fully fitted to the surface of the trunk 2. Additionally, the accessory 17, or rather its portions 17*a* and 17*b* is/are so shaped that the lateral edges of the front portion 17*a* and of the rear portion 17*b* are accurately aligned in the use position, i.e. when fitted according to FIG. 3, so as to give the impression of the accessory 17 fully encompassing the trunk 2 of the toy FIG. 1.

The mounting or putting-on of the accessory portions 17, 17' takes place simply by pressing the front and rear accessory portions into the detent members 13, 14 by means of the detent counter-members 15, 16, whereby to secure the accessory portions in place. To mount other accessory parts or to remove accessory parts the latter only require to be pulled off by exerting an appropriate amount of force.

The toy figures shown in FIGS. 2 and 3 are provided with further accessory parts additional to the accessory parts 17, 17' secured to the trunk 2, namely a hat 20 which is securable in a known manner with the aid of a socket pin 21 engaging in a corresponding notch 22 in the head 3.

As already mentioned, the shoes 12 are merely snapped on the ball extensions 11. They may similarly be pulled off from the extensions and replaced by other shoes.

The trunk region is also fitted with a neckerchief or bandana 23 as well as a belt 24 with a pistol holster 25. The neckerchief 23 is generally open at the rear side of the trunk and is clamped around the neck 26 to which end the neckerchief, or a cravat or tie, is made of a suitably resilient material. The belt 24 is merely hung over the trunk. Finally, the legs 9 are provided with covering parts 27 (leggings, chaps) which may for instance serve to represent relatively baggy trousers of a diameter greater than that of the legs 1. These covering parts 27 are formed with an essentially U-shaped cross-section and are made of a material that is only sufficiently resilient to enable them to be snapped over the legs 9. The upper edges 28 of the parts 27 terminate below the trunk 2 in the illustrated embodiment in order to make it possible to pivot the legs 9 upwardly and thus to enable the FIG. 1 to sit. Self-evidently it would be conceivable to prolong the parts 27 further upwardly, as is provided anyway at the side at 29, whereby the opening 8 is fully covered over and the impression of complete trousers is given.

It should not need further explanation that the shape of the accessories may very extensively vary from the shapes in illustrated embodiments, in order to obtain the most varied appearances. Also the shape and type of the detent member and of the detent counter-member may be changed, care being taken that the detent members and the detent counter-members at the trunk and at the accessory portions should be precisely matched to each other. In the toy figure according to the invention it is particularly significant that the actual basic shape of the trunk as shown in FIG. 1, may be fundamentally changed by the accessories, e.g. starting from a male trunk or torso a female from may be constructed.

I claim as my invention:

1. In a toy figure made from plastics including a head, a trunk, a pair of arms having pivot connections to said trunk, a pair of legs and a representation of a garment piece fittable to at least the trunk, wherein the garment piece completely surrounds the trunk of the toy figure and is divided into a front portion and a rear portion along a vertical plane passing through said pivot connections of the arms and which have side edges alignable with each other, the front and the rear portions of the garment piece being respectively separately securable on the trunk by means of a single detachable detent connection at the frontside and a single detent connection at the rearside of the toy figure, the detent connections each comprising a detent member and a detent counter member.

2. A toy figure according to claim 1 wherein the detent member is constituted by a recess in the trunk into which the detent counter member which comprises an internal projection of the garment piece is pressable in the fitted position.

3. A toy figure according to claim 2 wherein the recess of the trunk and the projection of the garment piece are circular in plan view.

4. A toy figure according to claim 2 wherein the cross-section of the recess in the trunk widens in the direction away from the trunk surface and the associated projection widens correspondingly.

5. A toy figure according to claim 1 wherein at least the front and rear portions with their associated detent counter-members are made of one piece from a slightly resiliently deformable plastics material.

6. A toy figure according to claim 1, wherein the internal surfaces of the front and rear portions of the garment piece are fitted to those regions of the trunk surfaces which are covered by the garment piece in the use position.

* * * * *